US006742431B1

(12) United States Patent
Oh

(10) Patent No.: US 6,742,431 B1
(45) Date of Patent: Jun. 1, 2004

(54) PUNCHING DEVICE FOR EDGE DECORATION HAVING ROTATION UNIT

(75) Inventor: Wan-Young Oh, Seoul (KR)

(73) Assignee: DN Craft Corporation, Seoul (KR)

( * ) Notice: Subject to any disclaimer, the term of this patent is extended or adjusted under 35 U.S.C. 154(b) by 0 days.

(21) Appl. No.: 10/388,155

(22) Filed: Mar. 13, 2003

(51) Int. Cl.[7] ..... B26F 1/14; B26D 7/02

(52) U.S. Cl. ..... 83/687; 83/36; 83/44.7; 83/691; 83/588; 83/633; 83/466.1; 83/453; 83/439; 83/249; 30/358

(58) Field of Search ..... 83/684–687, 690, 83/691, 910, 613, 633, 637, 588, 439, 440, 442, 569, 670, 466.1, 444, 36, 621, 698.21, 30, 660, 449, 267, 705, 418, 411.7, 249, 453; 434/81, 82; 33/423, 627, 628, 630; 30/358, 278, 363, 364

(56) References Cited

U.S. PATENT DOCUMENTS 1,678,319 A * 7/1928 Blessing ..... 83/223
2,085,079 A * 6/1937 Broadwell ..... 30/229
2,350,238 A * 5/1944 Knight ..... 83/161
3,355,975 A * 12/1967 Anfuso ..... 83/411.7
3,706,249 A * 12/1972 Bruckner ..... 83/69
3,906,826 A * 9/1975 Middendorf ..... 83/267
5,797,306 A * 8/1998 Kufahl ..... 83/257
6,000,139 A * 12/1999 Chan ..... 30/358

* cited by examiner

*Primary Examiner*—Boyer D. Ashley
(74) *Attorney, Agent, or Firm*—Welsh & Katz, Ltd.

(57) ABSTRACT

A punching device for edge decoration having a rotation unit which is capable of punching out a predetermined pattern repeatedly along an edge of a workpiece while accurately rotating the workpiece at a regular pitch is disclosed. This punching device includes a base (18) to which a workpiece is supplied, a jig (15) mounted on the base (18) and having a pattern hole (17) of a predetermined pattern, a punching member (13) formed in correspondence with the pattern hole (17), the punching member (13) passing through the pattern hole (17) to perforate the workpiece, a rotating unit for rotating the workpiece supplied on the base (18) so as to form a diagram in the workpiece by successive punching, and a fixing unit for fixing the workpiece to the rotating unit. A locking unit may be further provided for intermittently locking the rotation of the workpiece executed by the rotating unit. The locking unit includes a recess (19) formed on the base (18) at a rotational center of the workpiece, a rotation plate (22) rotatably received in the recess (19), and a handle (26) for rotating the rotation plate (22).

9 Claims, 13 Drawing Sheets

PUNCHING DEVICE FOR EDGE DECORATION HAVING ROTATION UNIT

BACKGROUND OF THE INVENTION

1. Field of the Invention

The present invention relates to a punching device for edge decoration, and more particularly to a punching device having a rotation unit which is capable of punching a predetermined pattern repeatedly along an edge of a sheet of material while accurately rotating the material at a regular pitch.

2. Description of the Related Art

Generally, a punching device has a jig on which a pattern hole corresponding to a specific pattern to be punched is perforated, and a cutter having a sharp edge and passing through the pattern hole. The punching device may punch a specific area of a workpiece according to the pattern of the pattern hole.

Currently, widely used punching devices have various configurations, but they are mostly purposed to pick away the workpiece in a specific shape. Thus, the conventional punching devices are not appropriate for repeated punching along an edge of the workpiece.

Conventionally, when a sheet of material such as a card, a letter paper, a picture or various boards needs to be punched successively the same pattern on the edge thereof using a hand-operated punching device, a user should punch the workpiece with determining a punching spot by eye measurement because nothing to guide or align displacement of the workpiece is provided. Thus, such conventional manual works frequently give rise to errors, so the punched patterns are apt to be irregular.

SUMMARY OF THE INVENTION

The present invention is designed to solve such problems of the prior art, and therefore it is an object of the present invention to provide a punching device for edge decoration having a rotation unit, which is capable of rotating a workpiece accurately at a regular pitch and continuously punching the workpiece along its edge.

In one aspect of the present invention, there is provided a punching device which includes a base to which a workpiece is supplied; a jig mounted on the base and having a pattern hole of a predetermined pattern; a punching member formed in correspondence with the pattern hole, the punching member passing through the pattern hole to perforate the workpiece; a rotating unit for rotating the workpiece supplied on the base so as to form a diagram in the workpiece by successive punching; and a fixing unit for fixing the workpiece to the rotating unit.

Preferably, the rotating unit includes a recess formed on the base at a rotational center of the workpiece; a rotation plate rotatably received in the recess; and a handle for rotating the rotation plate.

In this case, the fixing unit may fix the workpiece, which is positioned on the rotation plate, to the rotation plate so that the workpiece rotates together with the rotation plate.

The fixing unit may include a rubber plate formed on an upper surface of the rotation plate; and a fixing pin formed on a lower surface of the handle so as to put into the rubber plate with passing through the workpiece.

The fixing unit may also include a first magnet combined to the rotation plate; and a second magnet combined to the first magnet by magnetic attraction with the workpiece being interposed between the first and second magnets.

In another aspect of the invention, there is also provided a punching device which further includes a locking unit for intermittently locking the rotation of the workpiece executed by the rotating unit.

This punching device may further include a guide step formed on the base in order to guide an outer circumference of the workpiece positioned on the rotation plate while the workpiece rotates.

In addition, the locking unit may include locking grooves formed at a regular interval on one of the rotation plate and the recess; and a latch formed on the other one of the rotation plate and the recess so as to contact with the locking grooves selectively while the rotation plate rotates.

At this time, it is preferred that the distance between the pattern hole and the rotational center is identical to a radius of a circular-polygon having a circumference corresponding to integer times of the length of the pattern hole.

Moreover, the locking unit may include a number of locking grooves formed at a regular interval on one of the rotation plate and the recess, the number of the locking grooves being identical to the integer; and a latch formed on the other one of the rotation plate and the recess so as to contact with the locking grooves selectively while the rotation plate rotates.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
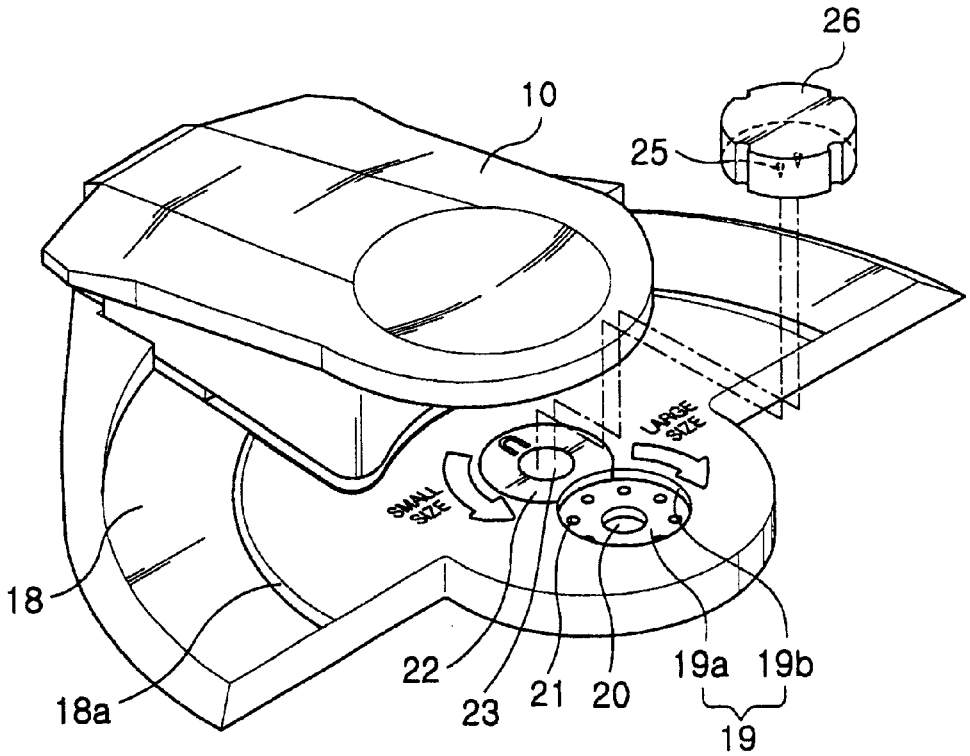
FIG. 1 is a perspective view showing appearance of a punching device according to a preferred embodiment of the present invention.

Hereinafter, the present invention will be described in more detail referring to the drawings.

Figure 2:
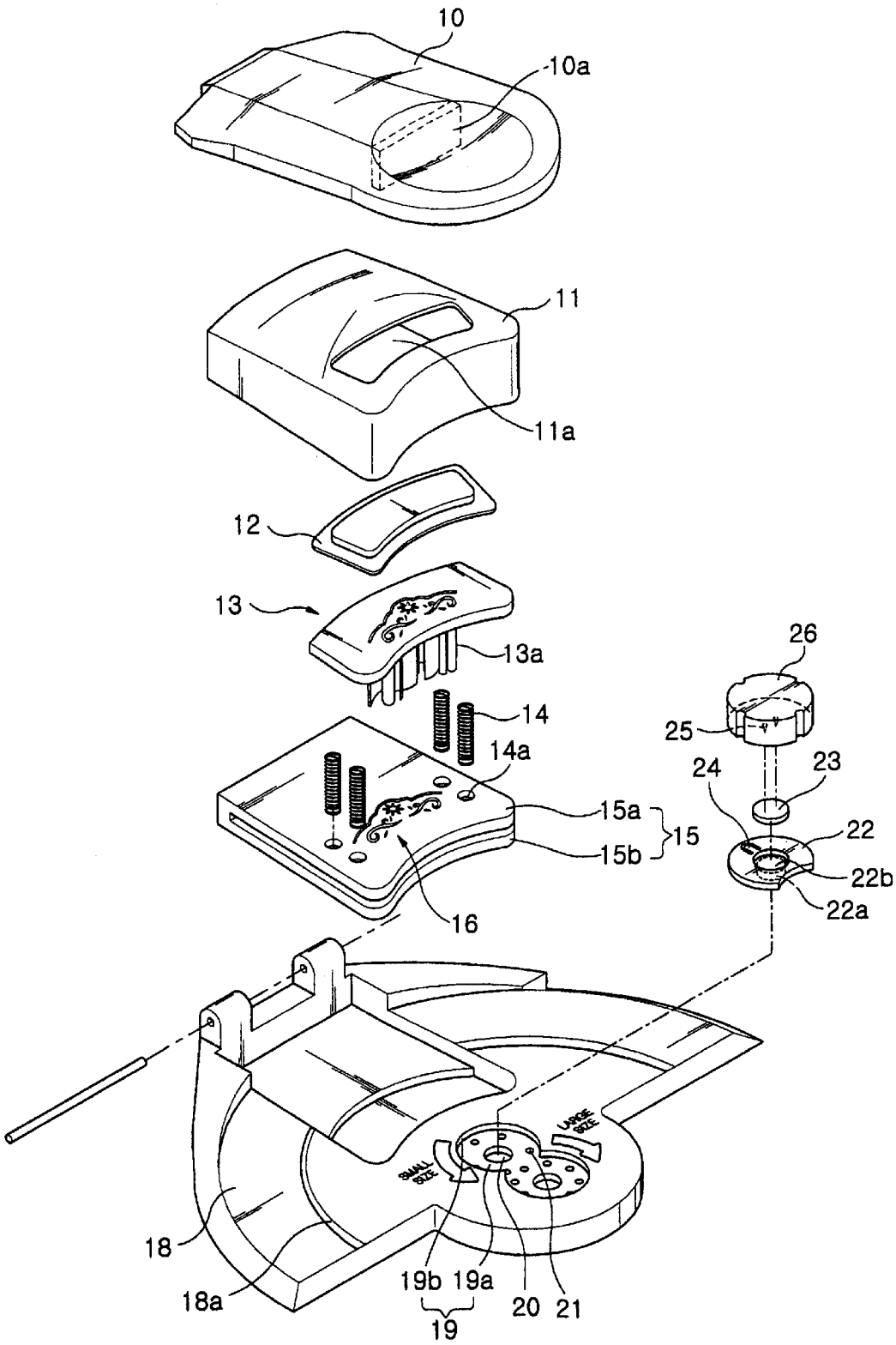
FIG. 2 is an exploded perspective view showing the punching device of FIG. 1.

At first, FIG. 1 is a perspective view showing appearance of a punching device according to a preferred embodiment of the present invention, and FIG. 2 is an exploded perspective view showing the punching device in more detail. Referring to FIGS. 1 and 2, the punching device of the present invention includes a pressing lever 10, a punching member 13, a jig 15, and a base 18. In addition, the punching device of the present invention further includes a recess 19, a rotation plate 22, a locking unit and a fixing unit in order to rotate the workpiece at a regular pitch according to the manipulation of a handle 26.

The pressing lever 10 is connected to the base 18 to be vertically pivotable so that the pressing lever 10 presses the punching member 13 downward when pushed down by a user.

Figure 3:
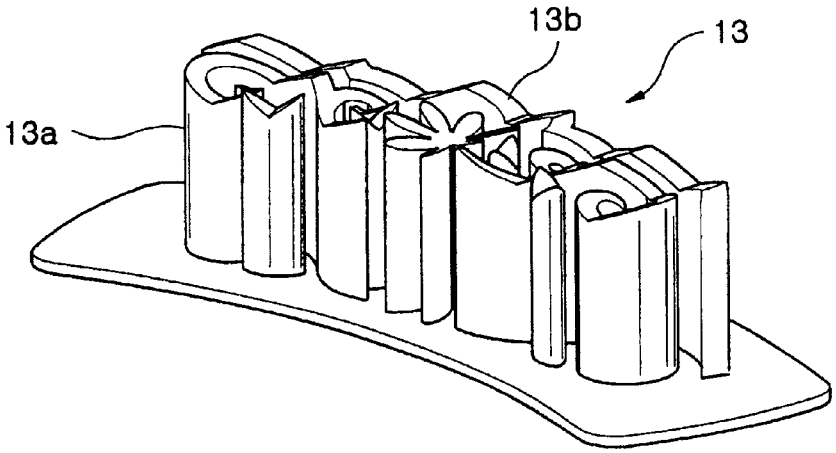
FIG. 3 is a perspective view showing an example of a punching member shown in FIG. 2.

The punching member 13 cuts away a workpiece in a desired pattern. For this purpose, a punch pin 13*a* having a shape corresponding to the pattern is formed downward on the punching member 13. At a lower edge of the punch pin 13*a*, formed is a sharp cutting blade (not shown) for easily and clearly punching the workpiece. Preferably, the punching member 13 has a rim cutter 13*b*, as shown in FIG. 3, which is used to cut off unnecessary margins outside the pattern when punching.

The jig 15 supports a supplied workpiece to be punched. This jig 15 preferably includes upper and lower plates 15*a* and 15*b*, facing in parallel each other with a space into which a workpiece to be punched can be inserted.

In the lower plate 15*b*, a pattern hole corresponding to the punch pin 13*a* is perforated. In the upper plate 15*a*, a guide hole 16 is formed to guide vertical movement of the punch pin 13*a*. Alternatively, the jig 15 may be configured to have a plate (not shown) which a pattern hole is perforated and a guide (not shown) for pressing and guiding a workpiece which is supplied on an upper or lower surface of the plate.

An elastic member 14 is interposed between the punching member 13 and the jig 15 for elastically biasing the punching member 13 upward. Thus, after descending and punching a workpiece supplied to the jig 15, the punching member 13 ascends again to initial position by means of elastic force of the elastic member 14. More specifically, the elastic member 14 may be a spring one end of which is combined to a fixing groove 14*a* formed on the upper plate 15*a* and the other end of which is combined to the punching member 13 to provide elastic force to the punching member 13. The elastic member 14 may adopt various kinds of springs, and they can be combined in various ways.

Preferably, the punching member 13 is stably combined to the jig 15 within a housing 11. A through hole 11*a* is formed on an upper surface of the housing 11 so that a press pin 10*a* formed at the pressing lever 10 passes through the through hole 11*a* to press an upper surface of the punching member 13.

More preferably, a cap member 12 may be further provided between the pressing lever 10 and the punching member 13 so as to prevent them from contacting directly each other and ensure their smooth operation. This cap member 12 contacts with the upper surface of the punching member 13 over a large area. Thus the cap member 12 may disperses pressure evenly to overall upper surface of the punching member 13 though the press pin 10*a* is in contact with the cap member 12 in a small area.

The pressing lever 10 is pivotably combined on the base 18 upon which the workpiece is supplied. In addition, a guide step 18*a* having an arc shape is formed on the base 18 in order to guide the workpiece to be supplied in a circumferential direction. Thus, in case of punching a circular workpiece, the guide step 18*a* guides an outer circumference of the rotating workpiece so as to arrange a position of the workpiece.

A recess 19 is formed on the base 18 so that the rotation plate 22 may rest therein. This recess 19 becomes a rotational center of a circular workpiece which is rotating on the base 18, as described below, and is preferably configured with a bottom 19*a* and a side 19*b*.

Figure 6:
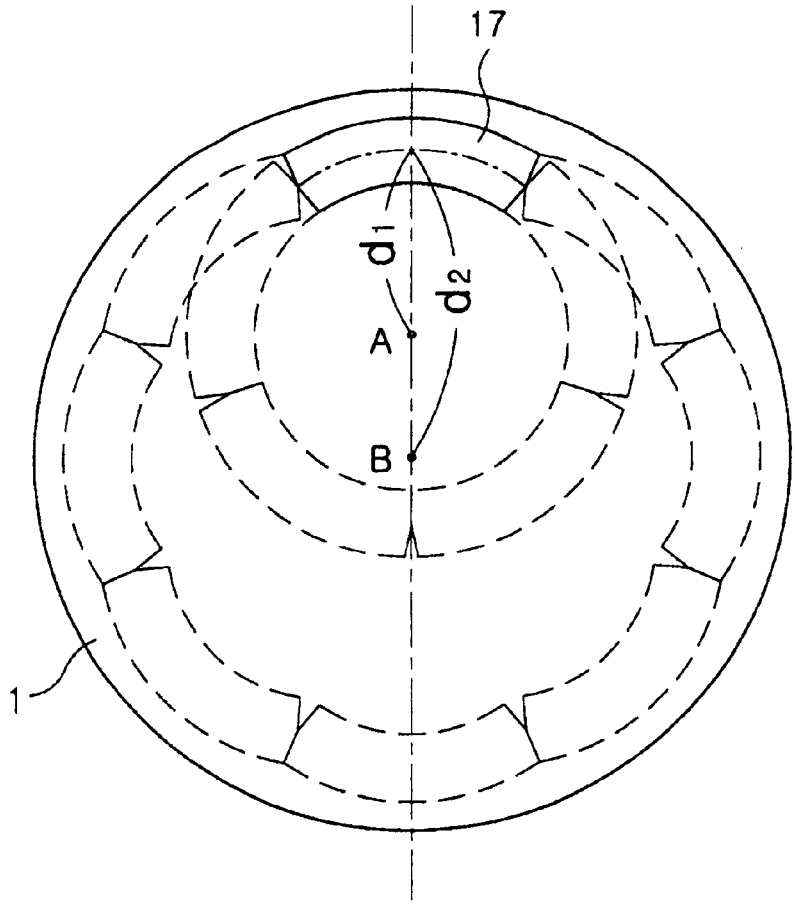
FIG. 6 is a schematic view for illustrating that the punching device punches circular-polygon patterns such as circle or polygon having different sizes depending on the distance between a rotational center of a rotation plate and a pattern hole.

This recess 19 may be formed at least two different positions depending on the size of the workpiece or the size and the radius of curvature of the pattern holes (see 17 of FIG. 6). In the example shown in the figure, two different recesses 19 corresponding to two punching patterns shown in FIG. 6 are provided in the base 18.

The rotation plate 22 is rotatably combined on the recess 19. For this purpose, the rotation plate 22 preferably has a disk shape having a diameter smaller than that of the recess 19, enabling the recess 19 to receive the rotation plate 22. In addition, the thickness of the rotation plate 22 is preferably set so that an upper surface of the rotation plate 22 becomes even with the surface of the base 18 when combined on the recess 19.

The shape of the rotation plate 22 is not limited to a perfect circle. In case two different recesses 19 are adjacently formed to have an overlap portion as shown in the figures, at least one of the rotation plates 22 installed in the recesses 19 is preferably configured so that an area corresponding to the overlap portion is cut off. Thus, two rotation plates 22 may be installed in the respective recesses 19.

In addition, it is also preferred that a center hole 20 is formed at the center of the bottom 19*a* of the recess 19 and a side 22*a* is formed downward at the center of the rotation plate 22 so that the side 22*a* is inserted into the center hole 20. In this configuration, the rotation plate 22 may rotate on the recess 19 more stably.

The locking unit is provided to the base 18 and the rotation plate 22, or to the recess 19 and the rotation plate 22 in order to periodically lock the rotation plate 22 at a regular interval while the rotation plate 22 rotates.

Preferably, this locking unit has a plurality of locking grooves 21 formed on the bottom 19*a* of the recess 19 at a regular interval, and a latch 24 formed on the rotation plate 22 so that the latch 24 is elastically combined with the locking grooves 21. Thus, while the rotation plate 22 rotates, the latch 24 is selectively locked to each locking groove 21. The latch 24 can be made of synthetic resin in the form of protrusion or elastically combined to the locking grooves 21 by means of an elastic body (not shown). As an alternative, the locking grooves may be formed on the projection 19*b* at a regular interval.

Preferably, a plurality of the locking grooves 21 may be formed on one of the base 18 and the rotation plate 22, and the latch 24 elastically contacting with the locking grooves 21 according to the rotation of the rotation plate 22 may be formed on the other one.

Figure 4:
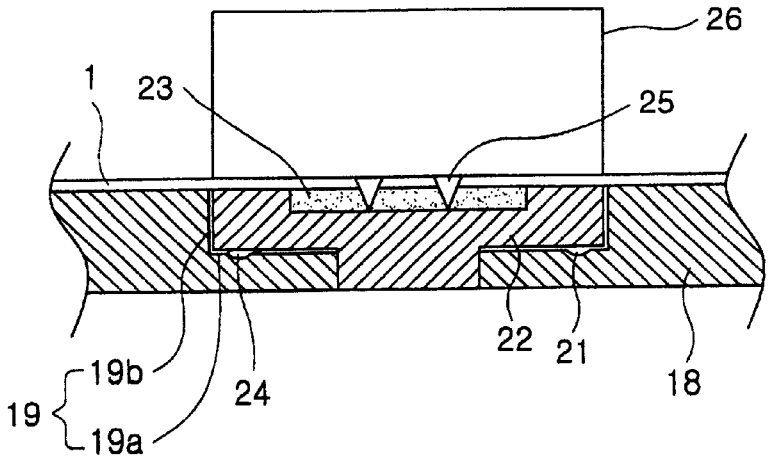
FIG. 4 is a side sectional view showing an example of a fixing unit configured in the punching device of the present invention.

The fixing unit fixes a workpiece supplied on the base 18 so that the workpiece rotates together with the rotation plate 22. For this purpose, the fixing unit preferably includes a rubber plate 23 formed on the upper surface of the rotation plate 22 and at least two fixing pins 25 which pass through the supplied workpiece (see 1 of FIG. 4) to fix the workpiece to the rubber plate 23. This configuration is well shown in FIG. 4 in which the workpiece 1 is fixed to the rotation plate 22 by the fixing unit.

At this time, the rubber plate 23 is preferably configured as a disk rubber pad which can be fixed to the center hole (see 22*b* of FIG. 2) of the rotation plate 22. As an alternative, the rubber plate 23 can also be attached on the upper surface of the rotation plate 22.

More preferably, the fixing pin 25 is formed downward on a lower surface of the handle 26. In this case, the handle 26 may have grooves or protrusions along its circumference for convenient grip.

Figure 5:
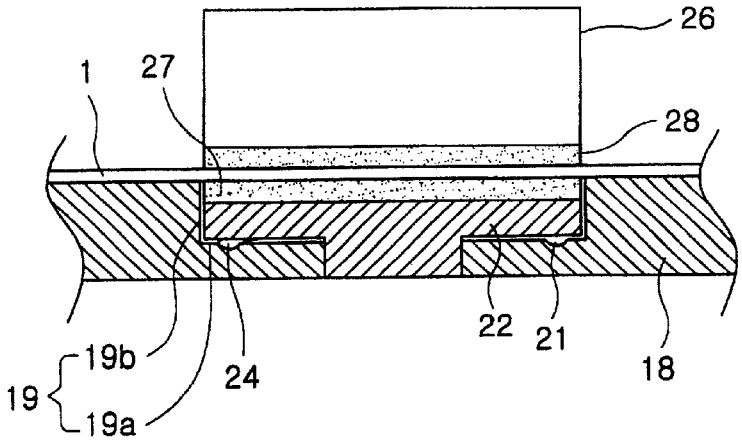
FIG. 5 is a side sectional view showing another example of the fixing unit configured in the punching device of the present invention.

Alternatively, the fixing unit may be configured using a magnet as shown in FIG. 5. In other words, the fixing unit may include a first magnet 27 formed on the rotation plate 22 and a second magnet 28 combined with the first magnet 27 by magnetic attraction so as to fix a workpiece 1 to the rotation plate 22, being interposed between the first and second magnets 27 and 28.

Here, the handle 26 for rotating the rotation plate 22 may be combined to the upper portion of the second magnet 28. In addition, the handle 26 may transfer a driving force to the rotation plate 22 through a gear train (not shown) mounted on the base 18.

According to the present invention, the distance between the pattern hole 17 and the rotational center of the rotation plate 22 should be set so that the punched workpiece may configure a 'circular-polygon'. The term 'circular-polygon' used in the description and the appended claims is defined as a diagram formed by successive punching of a pattern in the edge of the circular workpiece while rotating the circular workpiece integer times. A circle, equilateral polygons and flower-like diagrams may be included in the circular-polygon.

According to the present invention, in case a pattern is successively punched along its circumferential edge while rotating a circular workpiece intermittently, the length of the circumference of a circular-polygon should be integer times as long as that of the pattern hole 17 so that the punched diagram may configure the circular-polygon. At the same time, a radius of the circular-polygon satisfying such a condition should be identical to the distance between the pattern hole 17 and the rotational center of the rotation plate 22. In other words, it should be understood that the size of the punched circular-polygon is determined by the distance between the pattern hole 17 and the rotational center of the rotation plate 22.

FIG. 6 shows various circular-polygon having different sizes depending on the distance between the pattern hole 17 and the rotational center of the rotation plate 22. Referring to FIG. 6, in case the rotational center of the rotation plate 22 is in position A, a circular-polygon having a radius corresponding to the distance $d_1$ between the rotational center A and the pattern hole 17 is obtained by successively punching five times. On the while, in case the rotational center of the rotation plate 22 is in position B, a relatively larger circular-polygon having a radius corresponding to the distance $d_2$ between the rotational center B and the pattern hole 17 is obtained by successively punching eight times. In the figures, a dotted line shows a virtual perforated pattern formed when the workpiece is punched with being rotated on the axis of the rotational center of the rotation plate 22.

As mentioned above, since the distance between the pattern hole 17 and the rotational center of the rotation plate 22 is set so that the length of the circumference of the circular-polygon is integer times as long as that of the pattern hole, a perfect circular-polygon can be made by punching the workpiece as much as the number of times corresponding to the integer with rotating the rotation plate 22 and the workpiece 1 at a predetermined pitch. At this time, the locking grooves 21 of which the number is equal to the integer are formed in the recess 19 at a regular interval. For example, five locking grooves 21 may be formed on the recess 19 at a regular interval for the rotational center of position A in FIG. 6, while eight locking grooves 21 for position B. In this state, a user may obtain the above-mentioned circular-polygon by punching the workpiece with rotating the handle 26 intermittently by a pitch corresponding to the distance between locking grooves 21.

Now, an operation of the punching device constructed as above according to the present invention is described in more detail.

At first, a circular workpiece is preferably supplied between the upper and lower plates 15*a* and 15*b* of the jig 15, and then fixed on the rotation plate 22 by using the fixing unit. According to the example of the present embodiment, the handle 26 is combined downward to the rotation plate 22 so that the fixing pins 25 perforate the workpiece into the rubber plate 23.

Figure 7:
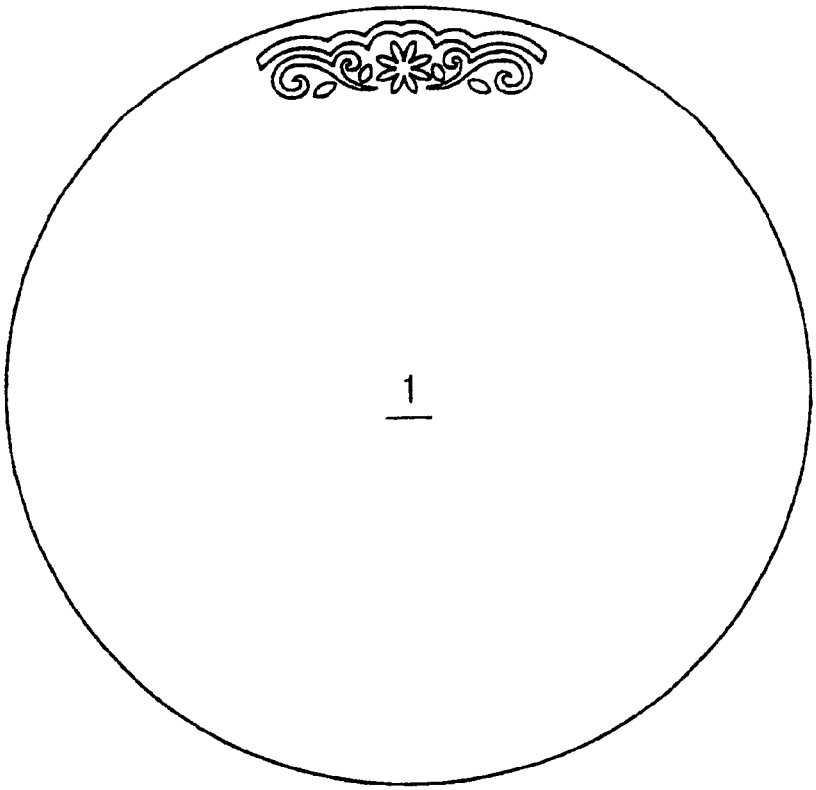
FIG. 7 shows a punched pattern of a workpiece which is punched for the first time when a latch is initially locked to a locking groove according to the present invention.

After that, a user turns the handle 26 to rotate the rotation plate 22 and then pushes down the pressing lever 10 at a point that the latch 24 is initially locked to one of the locking grooves 21. Then, a pattern corresponding to the pattern hole is perforated in the workpiece as shown in FIG. 7.

Figure 8:
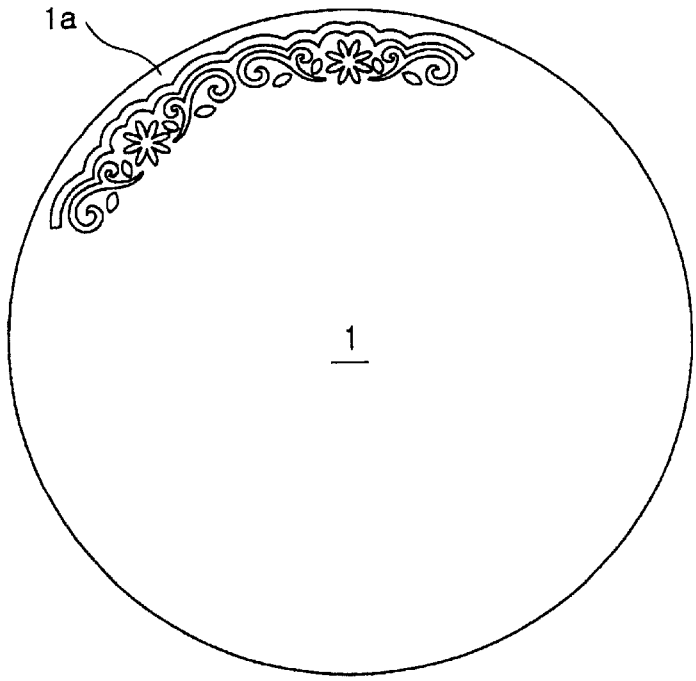
FIG. 8 shows a punched pattern of the workpiece which is rotated and then punched again when the latch is locked to the next locking groove after the state of FIG. 7.

Subsequently, the user rotates the rotation plate 22 as much as a predetermined pitch so that the latch 24 is locked to the next locking groove 21. Then, the user pushes down the pressing lever 10, so another pattern is perforated next to the previously perforated pattern, as shown in FIG. 8. At this time, since the rim cutter 13*b* is preferably configured to the punching member 13 as mentioned above, a margin 1*a* of the workpiece can be removed from the pattern during the punching process.

Figure 9:
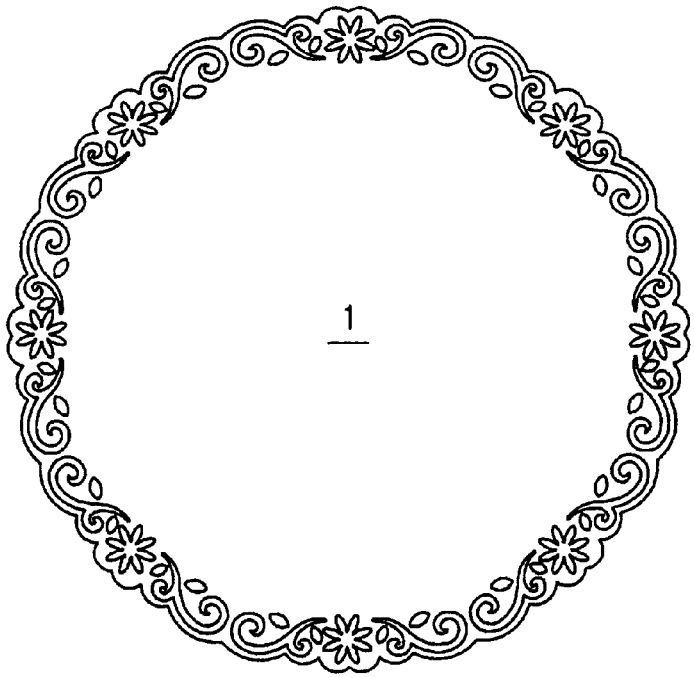
FIG. 9 shows a punched pattern of the workpiece which is continuously punched until the latch is locked to the last locking groove.

The user punches the workpiece successively with rotating the handle until the latch 24 is locked to the last locking groove 21, and then the margin 1*a* is completely separated off and the circular-polygon pattern is obtained along the rim of the workpiece 1, as shown in FIG. 9.

The shape of the circular-polygon varies depending on the length or shape of the pattern hole as well as the circumference of the circular-polygon.

Figure 10:
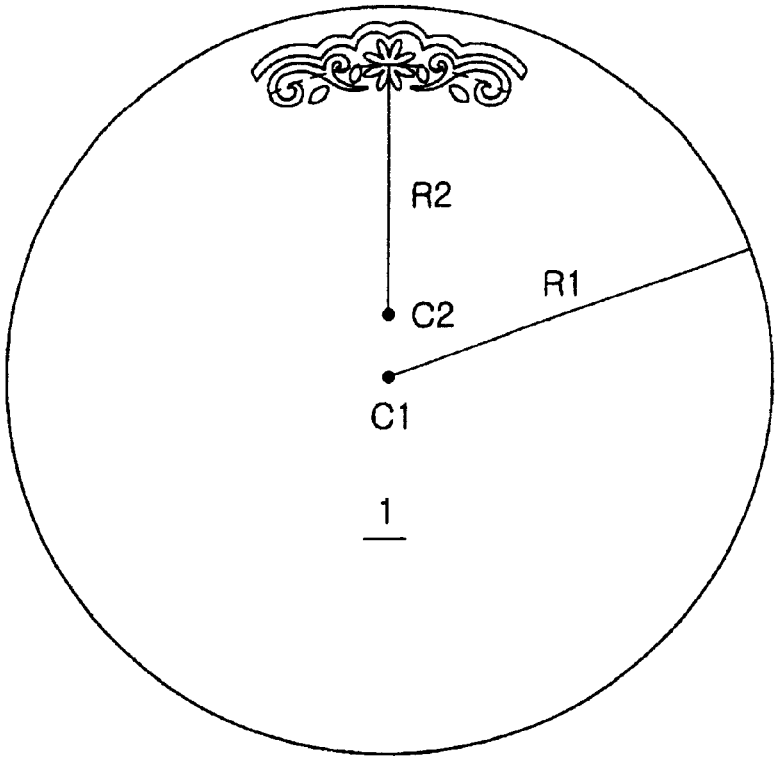
FIG. 10 is a diagram showing the radius of curvature of a circular workpiece and the radius of curvature of a punched pattern.
Figure 11:
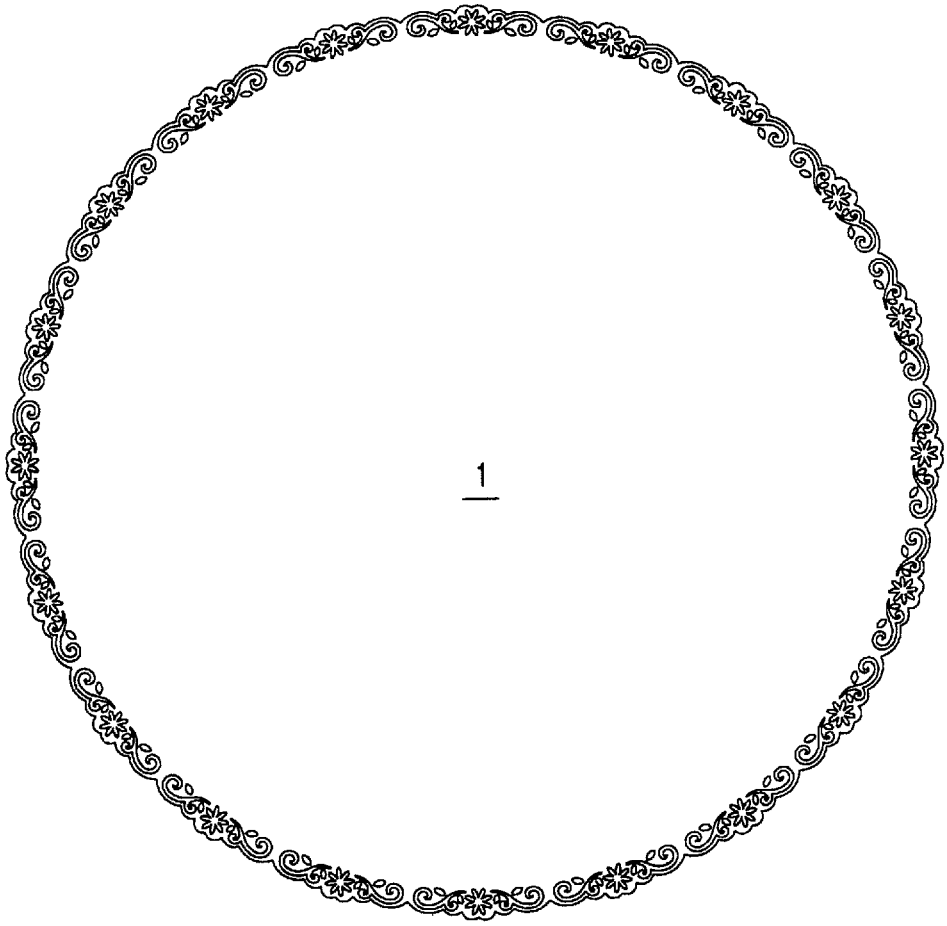
FIG. 11 shows a workpiece in which a circular-polygon pattern in a circular shape is formed by the punching device of the present invention.

For example, if the center C1 of the radius of curvature R1 of the workpiece 1 is coincident with the center C2 of the radius of curvature R2 of the pattern hole having a predetermined arc in FIG. 10, the shape of the perforated circular-polygon will be a circle as shown in FIG. 11.

On the other hand, if the centers are not coincident, the circular-polygon will have a flower shape since there is formed an angle between the patterns having a predetermined arc.

Figure 12:
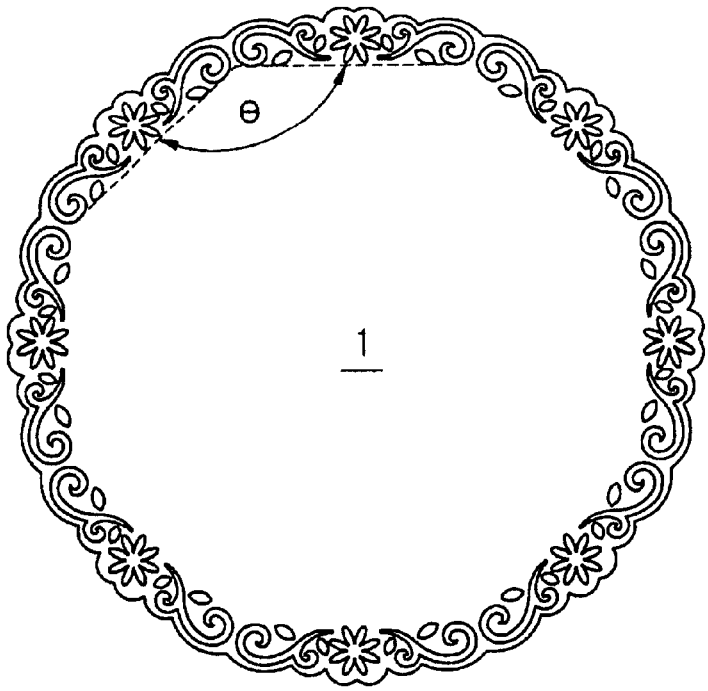
FIG. 12 shows a workpiece in which a circular-polygon pattern in a polygonal shape is formed by the punching device of the present invention.
Figure 13:
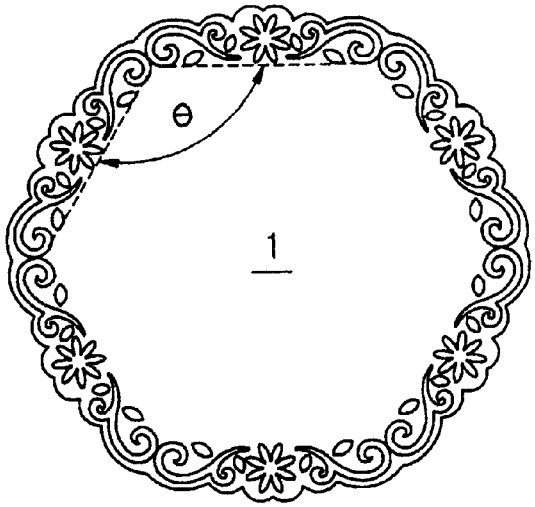
FIG. 13 shows a workpiece in which a circular-polygon pattern in a polygonal shape having an interior angle smaller than that of FIG. 12 is formed.

Or alternatively, if the pattern has a straight shape, an equilateral polygon having an interior angle θ is obtained as a circular-polygon as shown in FIG. 12. In addition, if the distance between the pattern hole and the rotational center is shorter, the circular-polygon becomes an equilateral polygon having a smaller interior angle as shown in FIG. 13.

The present invention has been described in detail. First of all, terms and words used in the specification and the claims should be interpreted not in a limited normal or dictionary meaning, but to include meanings and concepts conforming with technical aspects of the present invention, based on the face that inventors may appropriately define a concept of a term to describe his/her own invention in a best way. Therefore, the configurations described in the specification and drawn in the figures are just most preferred embodiments of the present invention, not to show all of the technical aspects of the present invention. So, it should be understood that there might be various equalities and modifications to be replaced with them.

Applicability to the Industry

The punching device according to the present invention is configured to conduct a punching process with rotating a workpiece by use of a rotation unit, so it may obtain regular and successive perforated patterns along a rim of the workpiece.

Thus, the punching device of the present invention enables to obtain various pattern arrangements such as circle, equilateral polygon or flower shape by punching a specific pattern successively in a workpiece. Therefore, the present invention gives an effect of punching an exquisite pattern along an edge of a workpiece such as card, letter paper, photograph or other boards, which need edge decoration.

What is claimed is:

1. A punching device comprising:

a base on which a workpiece is supplied;

a jig mounted on the base and having a pattern hole of a predetermined pattern;

a punching member formed in correspondence with the pattern hole, the punching member passing through the pattern hole to perforate the workpiece;

means for rotating the workpiece supplied on the base so as to form a diagram in the workpiece by successive punching, the rotating means having a recess formed on the base at a rotational center of the workpiece;

a rotation plate rotatably received in the recess;

a handle for rotating the rotation plate; and means for fixing the workpiece to the rotating means.

2. A punching device according to claim 1, wherein the fixing means fixes the workpiece, which is positioned on the rotation plate, to the rotation plate so that the workpiece rotates together with the rotation plate.

3. A punching device according to claim 2, wherein the fixing means includes:

a rubber plate formed on an upper surface of the rotation plate; and a fixing pin formed on a lower surface of the handle so as to perforate the workpiece into the rubber plate.

4. A punching device according to claim 2, wherein the fixing means includes:

a first magnet combined to the rotation plate; and a second magnet combined to the first magnet by magnetic attraction with the workpiece being interposed between the first and second magnets.

5. A punching device according to claim 1, further comprising a guide step formed on the base in order to guide an outer circumference of the workpiece positioned on the rotation plate while the workpiece rotates.

6. A punching device according to claim 1, further comprising means for intermittently locking the rotation of the workpiece executed by the rotating means.

7. A punching device according to claim 6, wherein the locking means includes:

locking grooves formed at a regular interval on one of the rotation plate and the recess; and a latch formed on the other one of the rotation plate and the recess so as to connect with the locking grooves selectively while the rotation plate rotates.

8. A punching device according to claim 6, wherein the distance between the pattern hole and the rotational center is equal to a radius of a circular-polygon having a circumference of which the length is integer times as long as that of the pattern hole.

9. A punching device according to claim 8, wherein the locking means includes:

locking grooves formed at a regular interval on one of the rotation plate and the recess, the number of the locking grooves being identical to the integer; and a latch formed on the other one of the rotation plate and the recess so as to contact with the locking grooves selectively while the rotation plate rotates.

* * * * *